US005954004A

United States Patent [19]

Futamura

[11] Patent Number: 5,954,004

[45] Date of Patent: Sep. 21, 1999

[54] METHOD OF SETTING STITCH PATTERN FOR EMBROIDERY REGION

[75] Inventor: Masao Futamura, Nagoya, Japan

[73] Assignee: Brother Kogyo Kabushiki Kaisha, Nagoya, Japan

[21] Appl. No.: 09/137,115

[22] Filed: Aug. 20, 1998

[30] Foreign Application Priority Data

Aug. 21, 1997 [JP] Japan ..... 9-224933

[51] Int. Cl.[6] ..... D05B 21/00; D05C 5/06

[52] U.S. Cl. ..... 112/102.5; 112/475.19; 112/445; 364/470.09

[58] Field of Search ..... 112/102.5, 470.06, 112/475.19, 445, 457; 364/470.09, 470.07

[56] References Cited

U.S. PATENT DOCUMENTS 5,474,000 12/1995 Mizuno et al. ..... 112/102.5

5,740,057 4/1998 Futamura ..... 364/470.09

FOREIGN PATENT DOCUMENTS

A-7-185162 7/1995 Japan .

*Primary Examiner*—Peter Nerbun

*Attorney, Agent, or Firm*—Oliff & Berridge, PLC

[57] ABSTRACT

A display 8 displays a plurality of embroidery regions R1 to R10 of an embroidery pattern. The user sets stitch patterns of the embroidery regions R1, R2, R5, R6 while viewing an input window IW. When the user presses a right mouse button 9*a* while a mouse pointer is located within the embroidery region R1, the stitch pattern of the embroidery region R1 is stored in a queue. Then by the user pressing a left mouse button while the mouse pointer is located within the embroidery region R3, the stitch pattern stored in the queue, that is, the stitch pattern of the embroidery region R1, is set as a stitch pattern of the embroidery region R3.

18 Claims, 7 Drawing Sheets

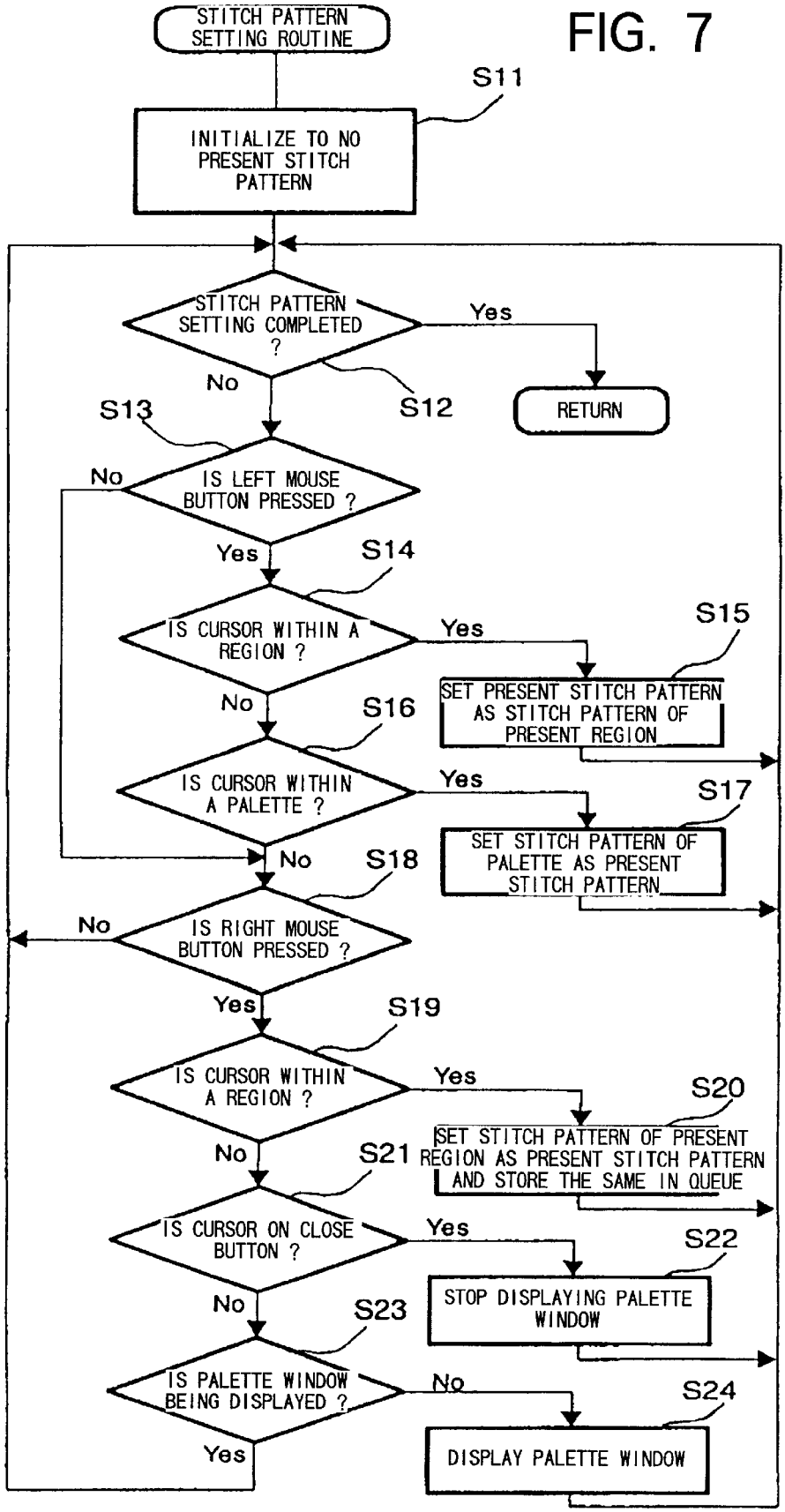
FIG. 7
STITCH PATTERN SETTING ROUTINE
S11
INITIALIZE TO NO PRESENT STITCH PATTERN
STITCH PATTERN SETTING COMPLETED ?
Yes
No
S12
RETURN
S13
IS LEFT MOUSE BUTTON PRESSED ?
No
Yes
S14
IS CURSOR WITHIN A REGION ?
Yes
S15
SET PRESENT STITCH PATTERN AS STITCH PATTERN OF PRESENT REGION
No
S16
IS CURSOR WITHIN A PALETTE ?
Yes
S17
SET STITCH PATTERN OF PALETTE AS PRESENT STITCH PATTERN
No
S18
IS RIGHT MOUSE BUTTON PRESSED ?
No
Yes
S19
IS CURSOR WITHIN A REGION ?
Yes
S20
SET STITCH PATTERN OF PRESENT REGION AS PRESENT STITCH PATTERN AND STORE THE SAME IN QUEUE
No
S21
IS CURSOR ON CLOSE BUTTON ?
Yes
S22
STOP DISPLAYING PALETTE WINDOW
No
S23
IS PALETTE WINDOW BEING DISPLAYED ?
No
S24
DISPLAY PALETTE WINDOW
Yes

METHOD OF SETTING STITCH PATTERN FOR EMBROIDERY REGION

BACKGROUND OF THE INVENTION

1. Field of the Invention

The present invention relates to a method of generating embroidery data and more specifically to a method of setting a stitch pattern for an embroidery region and also to a device capable of setting the same and a program storage medium storing a program of setting the same.

2. Description of Related Art

There has been known an embroidery data generating device for industrial use capable of generating embroidery data in a short time by using a microcomputer. This kind of embroidery data generating device includes a personal computer system used for a geneneral purpose, an image scanner, a key board, a mouse, a hard disk drive, and a cathode ray tube (CRT) display. With his embroidery data generating device, a user can generat embroidery data for a desired image in the following manne.

First, the user prepares an original document printed with the desired image, for example, a "flower" image shown in FIG. 1. As shown in FIG. 1, the "flower" image includes a plurality of regions R1 to R10 each defined by a separate outer peripheral line. It should be noted that an image is divided into a plurality of regions based on color. That is, each region is stitched with using thread in a single color. Then, the user inputs the outer peripheral line of each region R into the embroidery data generating device by tracing the outer peripheral line using a tablet. Alternatively, the user can input the outer peripheral lines by reading the "flower" image using the image scanner, displaying the read image on the CRT display, and tracing the outer peripheral lines on the CRT display using the mouse. Then, the outer peripheral lines of the "flower" image are displayed on the CRT display as shown in FIG. 1.

Next, the user sets a stitch pattern for each region R. The stitch pattern includes a stitch form, such as, tatami stitch and satin stitch, a stitch direction, a stitch density, and a thread color. For this example, it will be assumed that the user sets a stitch pattern for each of the regions R1 to R10 as shown in a Table 1.

TABLE 1

| | thread color | stitch form | stitch direction | stitch size |
|---|---|---|---|---|
| region R1 | red | tatami stitch | 45 degrees | |
| region R2 | red | tatami stitch | 135 degrees | |
| region R3 | red | tatami stitch | 45 degrees | |
| region R4 | red | tatami stitch | 135 degrees | |
| region R5 | yellow | satin stitch | 0 degree | |
| region R6 | yellowish green | satin stitch | 90 degrees | |
| region R7 | yellowish green | satin stitch | 90 degree | |
| region R8 | yellowish green | satin stitch | 0 degree | |
| region R9 | yellowish green | satin stitch | 0 degree | |
| region R10 | green | staggering stitch | | 2 mm |

In order to set the stitch patterns, first, the user uses the mouse and cursor to select a subject region R, for example, the region R1, displayed on the CRT display. Then, the embroidery data generating device is switched to its input mode, and an input indow IW shown in FIG. 2 is displayed on the CRT display. The input window IW includes a thread color box B1, a stitch form box B2, a stitch direction box B3, a stitch ensity box B4, an OK button B5, and a cancel button B6. Viewing the input window IW, the user manipulates the mouse or inputs numbers through the keyboard to input a value for each parameter by either selecting a check box or a box from a popup menu. For example, if the user desires stitches to extend in the upper right direction, the user inputs "45" in a direction box. Then, the user sets parameter values for the rest of the regions R2 to R10 in the same manner. It should be noted that because the region R10 has a linear shape and not a planar shape like the regions R1 to R9, when the user selects the region R10 as a subject region, the CRT display displays an input window (now shown) slightly different from the input window IW shown in FIG. 2. Then, the user inputs a stitch form, such as, a line stitch or staggering stitch, the desired width of stitch line and the like in a similar manner.

However, setting of stitch patterns is a time consuming operation and places a great burden on the user. As described above, the user needs to select a subject region R and input values of the parameters in alternation repeatedly for all regions R1 to R10. Moreover, because the user needs to operate both the mouse and the keyboard, the user repeatedly needs to move his or her hand from the mouse to the keyboard and back. Operation efficiency can be drastically lowered, especially when an image includes a large number of regions and a stitch pattern includes a large number of parameters.

Also, there has been provided a sewing machine for personal use and capable of sewing an embroidery pattern based on pre-stored embroidery data. However, there is an increasing demand for a sewing machine that enables a user to generate his or her own original embroidery data and capable of sewing generated embroidery pattern based on the user's original embroidery data. Therefore, in order to meet the user's demand, it is important to provide a method of generating embroidery data in a simple manner.

SUMMARY OF THE INVENTION

It is an object of the present invention to provide a method of setting stitch patterns for regions in a simple manner in a short time without placing a great burden on the user, a device capable of setting the same, and a program storage medium storing a program for setting the same.

In order to achieve the above and other objectives, there is provided a method of setting a stitch pattern of an embroidery region of an embroidery pattern. The method including the steps of displaying a plurality of embroidery regions making up an embroidery pattern on a display unit, selecting a first embroidery region out of the plurality of embroidery regions, storing a stitch pattern of the first embroidery region in a first memory, selecting a second embroidery region out of the plurality of embroidery regions, and setting the stitch pattern stored in the first memory as a stitch pattern of the second embroidery region.

There is also provided an embroidery data generating device including a display unit that displays a plurality of embroidery regions making up an embroidery pattern, an operation unit, a first memory that stores a stitch pattern of the first embroidery region selected by the user manipulating the operation unit, setting means for setting the stitch pattern stored in the first memory as a stitch pattern of a second embroidery region which is selected by the user manipulating the operation unit.

There is also provided a program storage medium storing a program for controlling an embroidery data generating device. The program includes a program of displaying a plurality of embroidery regions making up an embroidery pattern on a display unit, a program of selecting a first embroidery region out of the plurality of embroidery regions displayed on the display unit, a program of storing a stitch pattern of the first embroidery region in a first memory, a program of selecting a second embroidery region out of the plurality of embroidery regions, and a program of setting the stitch pattern stored in the first memory as a stitch pattern of the second embroidery region.

BRIEF DESCRIPTION OF THE DRAWINGS

The particular features and advantages of the invention as well as other objects will become more apparent from the following description taken in connection with the accompanying drawings, in which:

FIG. 7 represents a flowchart of a stitch pattern setting routine included in the main routine shown in FIG. 5;

DETAILED DESCRIPTION OF THE PREFERRED EMBODIMENT

An embroidery data generating device according to a preferred embodiment of the present invention will be described while referring to the accompanying drawings.

Figure 3:
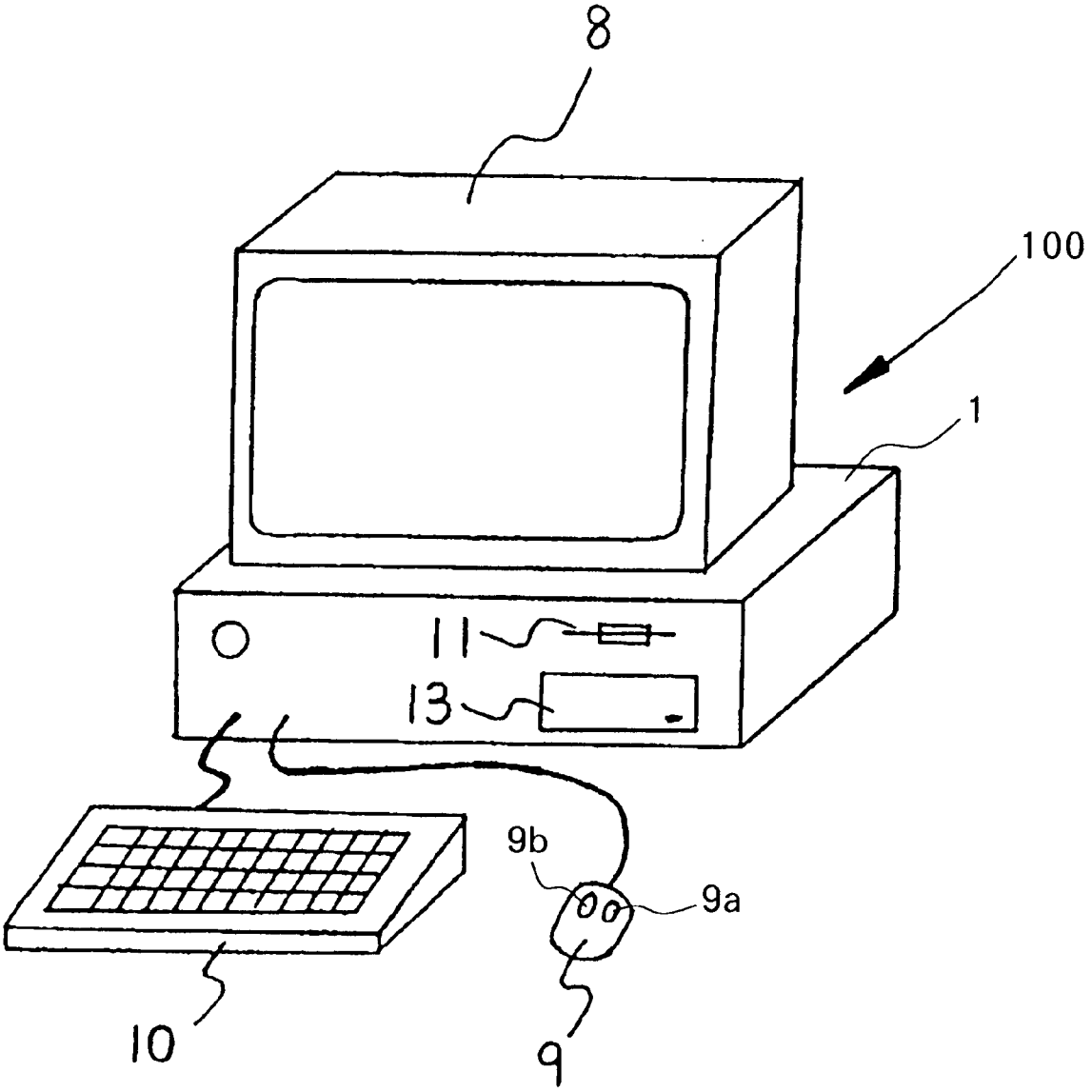
FIG. 3 is a perspective view showing the embroidery data generating device according to the present invention.
Figure 4:
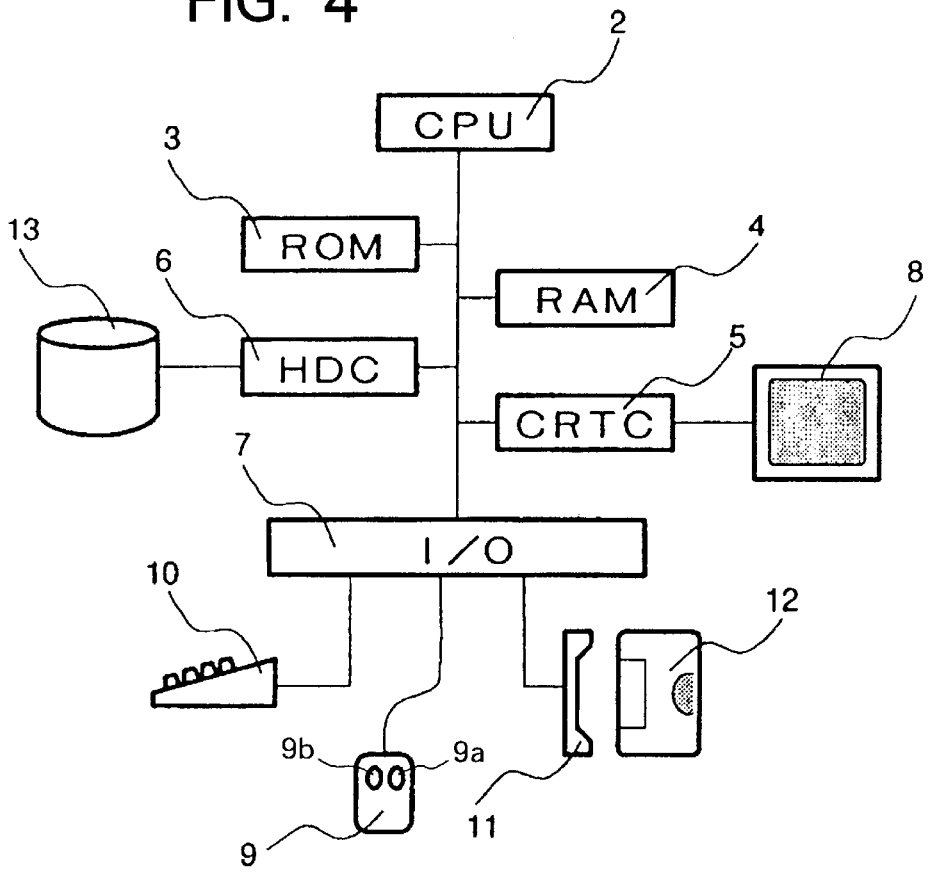
FIG. 4 is a block diagram showing electric components of the embroidery data generating device of FIG. 3.

First, a configuration of an embroidery data generating device 100 according to the present invention will be described while referring to FIGS. 3 and 4. The embroidery data generating device 100 includes a main body 1, a display unit 8, a mouse 9, and an operation unit 10. The main body 1 is a well-known personal computer including a central processing unit (CPU) 2, a read only memory (ROM) 3, a random access memory (RAM) 4, a display control unit 5, a hard disc controller (HDC) 6, an interface 7, a card connector 11, and a fixed storage 13. The CPU 2, the ROM 3, the RAM 4, the display control unit 5, the HDC 6, and the interface 7 are all connected to one another via a bus. The display unit 8 is connected to the display control unit 5 and displays images and various kinds of messages. The mouse 9, the operation unit 10, and the card connector 11 are individually connected to the interface 7. The mouse 9 includes a right mouse button 9*a* and a left mouse button 9*b*. A user operates the mouse 9 to input various kinds of commands. The display unit 8 also displays a cursor C whose movement corresponds to movement of the mouse 9. The operation unit 10 includes a number of keys, such as numeral keys, letter keys, and an end key. The user can input letters and numerals through the operation unit 10. The fixed storage 13 is connected to the HDC 6 and stores embroidery data and program codes including an embroidery data generating program code for use in generating embroidery data. The card connector 11 is for mounting a flash memory 12 in which embroidery data is stored.

Although not shown in the drawings, embroidery data generated by the above-described embroidery data generating device is used for sewing an embroidery pattern using an embroidery machine. This kind of embroidery machine is for personal use and includes a bed, a frame, a moving mechanism, a needle, a loop taker, and a microcomputer. The frame is mounted on the bed and holds a fabric. The moving mechanism moves the frame holding the fabric to predetermined positions represented by x and y values of an x-y coordinate system. The needle and the loop taker perform stitching operations while the moving mechanism moves the frame so that a predetermined embroidery pattern is formed on the fabric. The movements of the needle and the loop taker are controlled by the microcomputer based on embroidery data. The embroidery data indicates needle positions, that is, moving amounts for each single stitch in x and y directions needle positions. In this embodiment, the embroidery data of the "flower" image is stored in the flash memory 12, that is, a card memory. Because the embroidery machine is well known, its detailed description is omitted.

Figure 5:
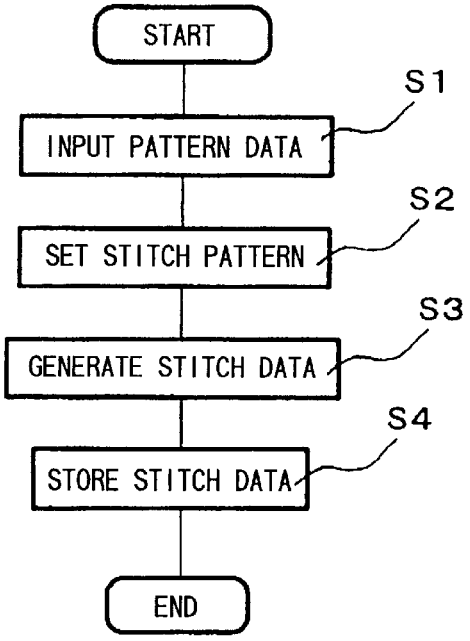
FIG. 5 represents a flowchart of a main routine of the embroidery data generating device of FIG. 3.

Next, processes of a main routine for generating embroidery data of the image "flower" will be described while referring to the flowchart shown in FIG. 5. It should be noted that when the embroidery data generating device 100 is turned ON, an initial program loader, which is stored in the ROM 3, is activated and controls the disk control device 6 to load the embroidery data generating program code from the fixed storage 13 into the RAM 4. Then, various functions for generating embroidery data are enabled.

Figure 6:
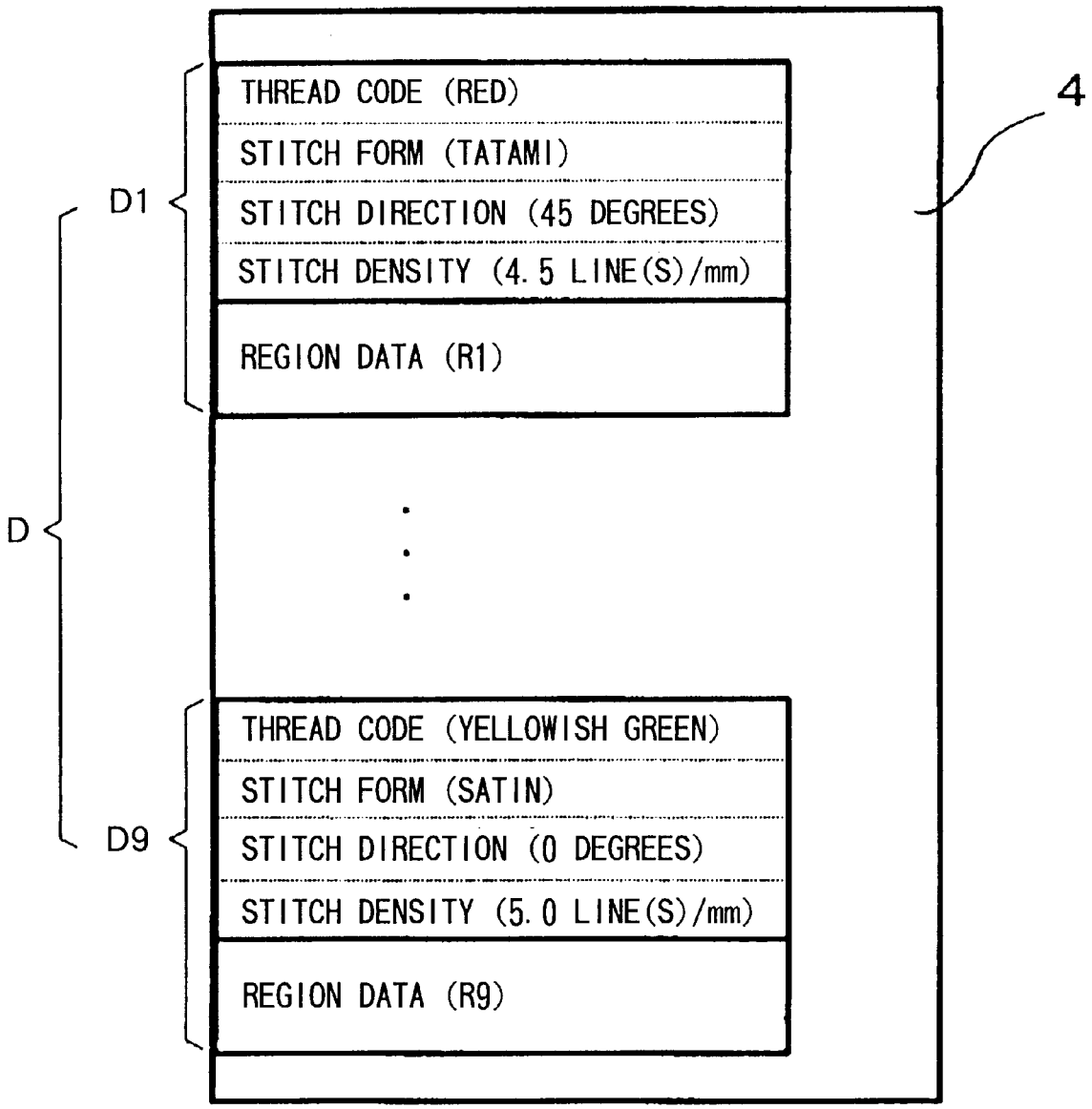
FIG. 6 shows embroidery data generated by the embroidery data generating device of FIG. 3.
Figure 8:
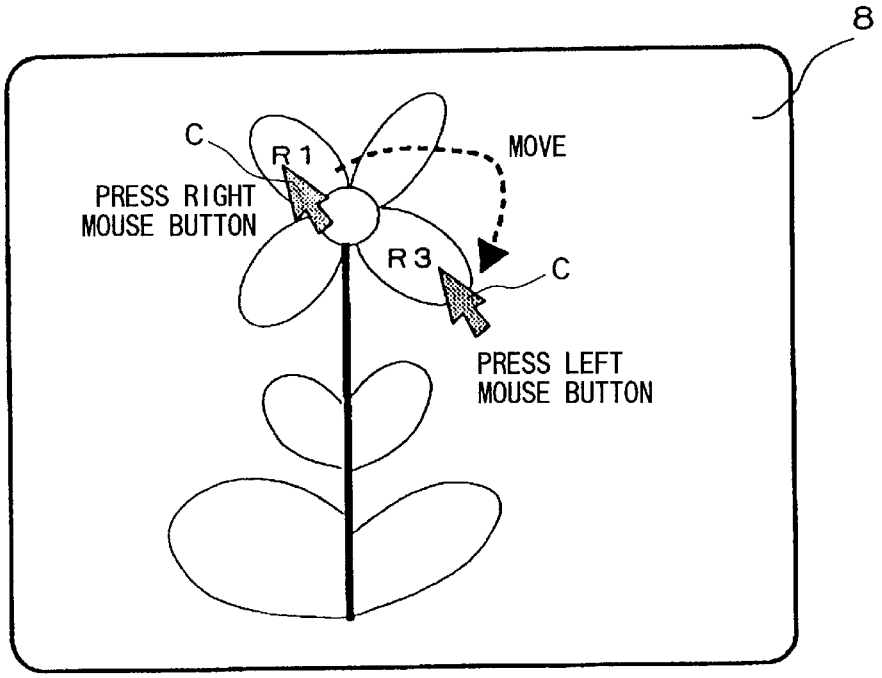
FIG. 8 shows a mouse operation for setting stitch patterns in a manner according to the present invention.

First, in S1, the user inputs pattern data into a predetermined region of the RAM 4 either by manipulating the mouse 9 and/or the operation unit 10 or by reading data prestored in the fixed storage 13. As shown in FIG. 6, the pattern data includes a plurality of sets of embroidery data D1 to D9 corresponding to the regions R1 to R9, respectively. The sets D1 to D9 are arranged in the order in which the regions R1 to R9 will be sewn. Each set of the embroidery data D includes stitch pattern data and region data. The stitch pattern data further includes data on stitch form, stitch direction, stitch density, and thread color. Each region is defined by a polygon having a number of apices. The region data indicates the number of the apices defining the polygon and x and y values thereof in a coordinate system. At this time, the pattern data has a predetermined initial value. It should be noted that although the description for the region R10 is omitted here, the embroidery data for the region R10 is generated and stored in the same manner as the embroidery data for the regions R1 to R9.

Then, in S2, a stitch pattern setting routine is executed where the user sets stitch patterns for each of the regions R1 to R9 in a manner described below. As shown in Table 1, the stitch patterns for the regions R1, R2, R6, R8 are the same as these for the regions R3, R4, R7, R9 respectively. Also, the stitch patterns for the regions R7 and R6 are the same as these for the regions R8 and R9 except for the stitch directions. To take advantage of these similarities, according to the present invention, the stitch patterns for regions R1, R2, R6 are copied and set as the stitch patterns for the regions R3, R4, R7, respectively. Also, the stitch pattern for the region R6 or R7 is copied and set as the stitch patterns for the regions R8 and R9 and then the stitch directions of the regions R8 and R9 are changed.

In this case, the user sets the stitch patterns for the regions R1, R2, R5, and R6 as shown in Table 2 in the conventional manner described above using the input window IW shown in FIG. 2.

TABLE 2

| | thread color | stitch form | stitch direction |
|---|---|---|---|
| region R1 | red | tatami stitch | 45 degrees |
| region R2 | red | tatami stitch | 135 degrees |
| region R5 | yellow | tatami stitch | 0 degree |
| region R6 | yellowish green | satin stitch | 90 degrees |

Then, the user copies the stitch pattern for the region R1 and sets it as the stitch pattern for the region R3. To perform this copy operation, the RAM 4 includes a first storage region and a second storage region. The second storage region is called a queue. The first storage region is for storing one set of stitch pattern data at a time. The stitch pattern corresponding to stitch pattern data, that is, data of a stitch pattern, stored in the first storage region is referred to as the present stitch pattern. The second storage region stores a predetermined number, five in this embodiment, of sets of stitch pattern data. The five sets of stitch pattern data are arranged in order of newest to oldest. Since only five sets can be stored in the queue, when a new set of stitch pattern data is stored in the queue while five sets of stitch pattern data are already stored, the oldest one of the five sets is deleted from the queue.

At the beginning of S2, the present stitch pattern is initialized to indicate that no present stitch pattern is set, that is, no stitch pattern data is stored in the first storage region. Then, the user sets the stitch pattern for the region R1 as the present stitch pattern. Then, the user sets the present stitch pattern as the stitch pattern for the region R3. That is, the user copies the stitch pattern for the region R1 as the stitch pattern for the region R3.

Specifically, the user manipulates the mouse 9 to place the cursor C within the region R1 of the image "flower" displayed on the display unit 8. Then, the user presses the right mouse button 9*a*. In this way, the stitch pattern for the region R1 is set as the present stitch pattern, and the stitch pattern is also stored in the queue. Then, the user manipulates the mouse 9 to place the cursor C within the region R3 and then presses the left mouse button 9*b*. In this way, the present stitch pattern, that is, the stitch pattern for the region R1, is copied and set as the stitch pattern for the region R3.

The user can set stitch patterns for the regions R4, R7 in the same manner described above.

Then, the user sets the stitch pattern for the region R8. As described above, the stitch pattern for the region R8 is the same as the stitch pattern for the region R7 except the stitch direction. Therefore, to set the stitch pattern for the region R8, the user first copies the stitch pattern for the region R7 to produce the stitch pattern for the region R8 and then the user alters the setting of the stitch direction.

Figure 9:
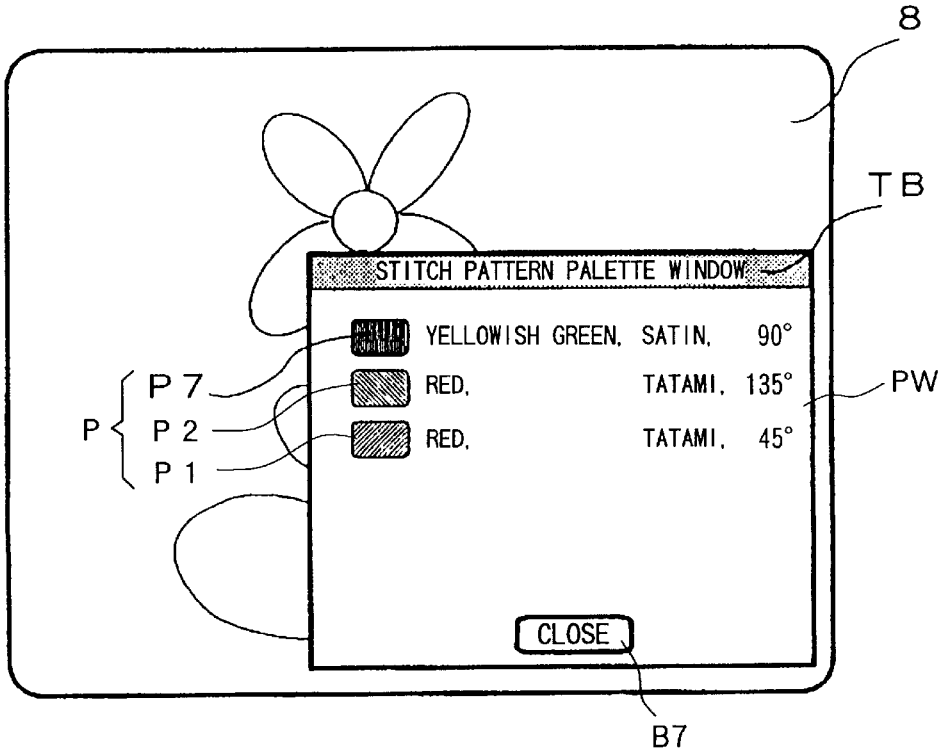
FIG. 9 shows a stitch pattern palette window displayed on a display of the embroidery data generating device of FIG. 3.

Specifically, the user places the cursor C outside of all the regions R1 to R10 and presses the right mouse button 9*a*. As a result, the display unit 8 displays a palette window PW shown in FIG. 9. The palette window PW shows stitch patterns stored in the queue in the order of newest to oldest, corresponding box regions called stitch palettes P, a close button B7, and a title bar TB. In this example, the palette window PW includes the stitch patterns and stitch palettes P7, P2, P1 for the regions R7, R2, R1. Then, the user places the cursor C within the stitch pallet P7 and presses the left mouse button 9*b*, thereby setting the stitch pattern for the region R7 as the present stitch pattern. Then, the user presses the left mouse button 9*b* while the cursor C is within the embroidery region R8. This copies the present stitch pattern, that is, the stitch pattern for the region R7, and sets it as that for the region R8. At this time, the user can move the palette window PW into any desired position by dragging the title bar TB if necessary. Also, by selecting the close button B7, the palette window PW can be removed. Therefore, even if the palette window PW is displayed over the image "flower" displayed on the display unit 8, the palette window PW can be moved or removed so that the user can view the image "flower".

Figure 1:
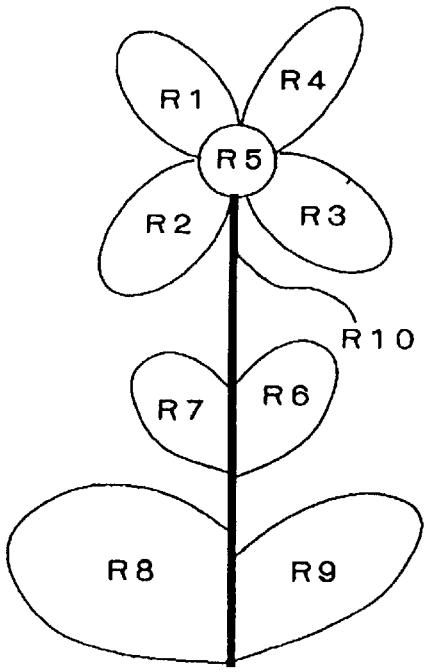
FIG. 1 shows an image "flower" as an example of embroidery pattern.
Figure 2:
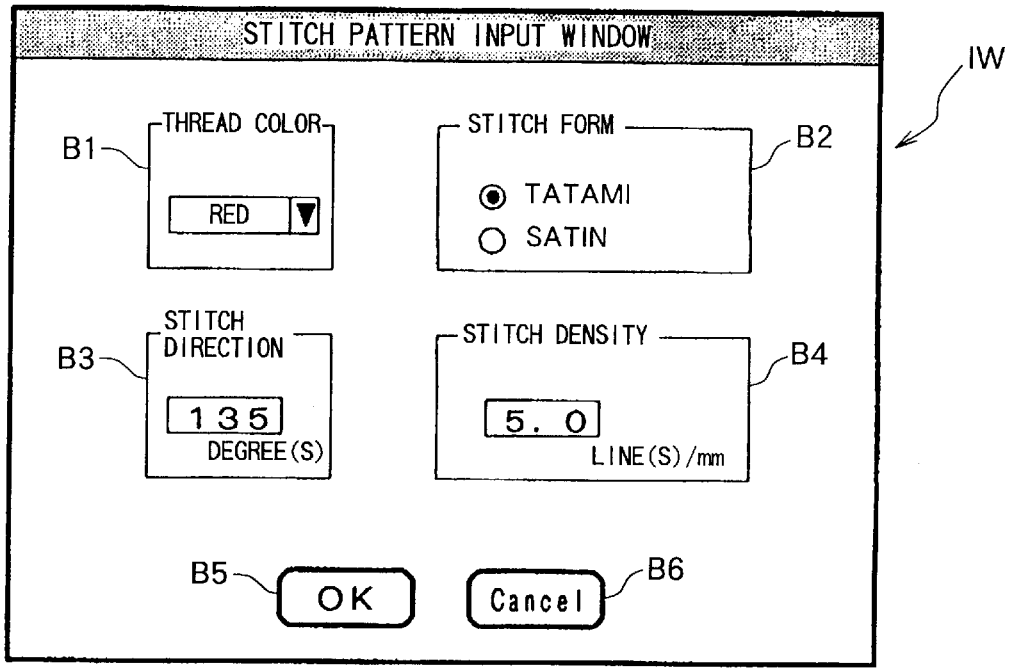
FIG. 2 shows an input window IW which a user uses to set stitch patterns in a conventional manner.

Then, the user alters the stitch direction in the conventional manner while viewing the input window IW shown in FIG. 2. Because the user does not need to set the values for all parameters of the stitch pattern, the user can set the stitch pattern in a simple manner in a short time.

The user can set the stitch pattern for the region R9 in the same manner as described above.

After the user completes setting of the stitch patterns for all regions R1 to R10, the user presses the end key on the operation unit 10. Then, stitch data is generated in S3 based on the stitch pattern data and the region data for each region R. The stitch data is x and y values in the coordinate system representing needle points necessary for stitching each region R. For the regions R1 to R9, needle points necessary for forming stitches within the entire area defined by the outer peripheral lines are calculated based on the stitch pattern data and the region data. Also, for the region R10, needle points necessary for forming stitches along a center of the line are calculated based on the stitch pattern data and the region data. Detailed description of generation of the stitch data will be omitted.

Further in S3, thread color codes and thread change codes are added to the stitch data in a conventional manner. Then in S4, the stitch data is stored as embroidery data of the "flower" image in the flash memory 12 through the interface 7 in a predetermined form readable by the embroidery machine.

When the flash memory 12 storing the stitch data is mounted in the embroidery machine, the user can obtain the embroidery image corresponding to the image "flower" using the embroidery machine.

Next, a stitch pattern setting routine executed in S2 will be described while referring to the flowchart shown in FIG. 7. First, setting of the stitch pattern for the region R3 will be described. In S11, the present stitch pattern is initialized to no present stitch pattern and no settings. Then, the user presses the right mouse button 9*a* while the cursor C is within the region R1 to set the stitch pattern for the region R1 as the present stitch pattern. In this case, because the mouse button is pressed without the end key being pressed, it is determined in S12 that the setting of the stitch patterns is not yet completed (S12:NO), in S13 that the left mouse button is not pressed (S13:NO), and in S18 that the right mouse button is pressed (S18:YES). Because the mouse button is pressed while the cursor C is located within the region R1, it is determined in S19 that the cursor C is within a region (S19:YES), and the process proceeds to S20 where the stitch pattern for the present region, that is, the region R1 in this example, is stored in the queue and also set as the present stitch pattern. Then, the process returns to S12. Then, the user presses the left mouse button 9*b* while the cursor C is within the region R3. Because the end key is not pressed, S12 results in a negative determination (S12:NO) and S13 in an affirmative (S13:YES). Because the cursor C is within the region R3 (S14:YES), the process proceeds to S15 where the present stitch pattern is set as the stitch pattern for the present stitch region, that is, the region R3. The program then returns to S12.

The stitch patterns for the regions R4, R7 are set using the same processes so detailed descriptions will be omitted.

Then, the stitch pattern for the region R8 is set. The user presses the right mouse button 9*a* (S12:NO, S13:NO, S18:YES) while the cursor C is located outside of all regions R1 to R10 (S19:NO). Then, the process proceeds to S21 where it is determined whether or not the cursor C is located on the close button B7 displayed on the palette window PW. If so (S21:YES), displaying of the palette window PW is stopped in S22 and the process returns to S12. Because the cursor C is not on the close button B7 in this example (S21:NO), it is determined in S23 whether or not the palette window PW is being displayed. If so (S23:YES), the program returns to S12. However, because the palette window PW is not being displayed in this example (S23:NO), the program proceeds to S24, whereupon the palette window PW is displayed. Then, the program returns to S12.

Next, the user presses the left mouse button 9*b* (S12:NO, S13:YES) while the cursor C is located within the stitch pattern palette P7 (S14:NO, S16:YES). Then, in S17, the stitch pattern of the present palette, that is, the stitch pattern palette P7, is set as the present stitch pattern. Afterward, the program returns to S12.

Then, when the user presses the left mouse button 9*b* (S12:NO, S13:YES) while the cursor C is within the region R8 (S14:YES), then in S15, the present stitch pattern is set as the stitch pattern for the region R8. Afterward, the program returns to S12.

Then, the user repeats the above-described operations for setting the stitch pattern for the region R9. After the setting of the stitch patterns is completed, the user presses the end key (S12:YES), and the present routine is ended.

As described above, according to the present invention, because the user can copy stitch patterns by manipulating only the mouse 9, the user can set desired stitch patterns in a simple manner in a short time. Also, the user can store a plurality of stitch patterns into the queue and display the stitch patterns on the palette window PW just by manipulating the mouse 9. Therefore, even when the user needs to deal with a large number of stitch patterns, the user can generate embroidery data in a simple manner. While the invention has been described in detail with reference to specific embodiments thereof, it would be apparent to those skilled in the art that various changes and modifications may be made therein without departing from the spirit of the invention, the scope of which is defined by the attached claims.

Figure 10:
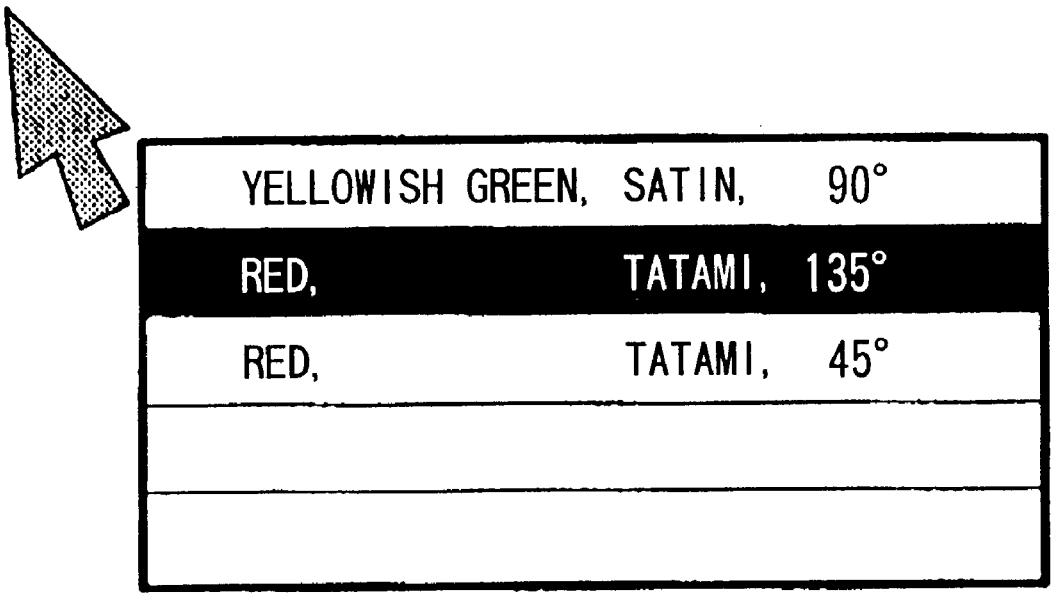
FIG. 10 shows a pop up menu displayed on the display of the embroidery data generating device of FIG. 3.

For example, although in the above-described embodiment stitch patterns stored in the queue are displayed on the palette window PW, the stitch patterns can be displayed on a popup menu shown in FIG. 10. Also, stitch patterns for linear regions can be set in the same manner as for stitch patterns for planar regions.

Also, although coordinate values are of needle points, that is, one-stitch data is generated as the stitch data in S3, data in well-known embroidery block form can be generated instead. In this case, however, the embroidery machine needs to be capable of converting the embroidery block data into one-stitch data. Further, the generated stitch data can be stored in a detachable data medium, such as floppy disk, or can be supplied to the embroidery machine via a wireless or cable communication circuit.

In the above described embroidery data editing device, the program for controlling setting of stitch patterns is prestored in the ROM 3. However, the program can be stored in a floppy disk, a CD-ROM, an optimagnetic disk, or a magnetic tape. Then, the embroidery data generating device can read the program through a reading unit or a communication circuit with or without a cable.

Also, in the present embodiment, the personal computer is used as the embroidery data editing device. However, the embroidery data generating device can be a microcomputer or be built in the embroidery device.

What is claimed is:

1. A method of setting a stitch pattern of an embroidery region of an embroidery pattern, comprising the steps of:

(a) displaying a plurality of embroidery regions making up an embroidery pattern on a display unit;

(b) selecting a first embroidery region out of the plurality of embroidery regions;

(c) storing a stitch pattern of the first embroidery region in a first memory;

(d) selecting a second embroidery region out of the plurality of embroidery regions; and (e) setting the stitch pattern stored in the first memory as a stitch pattern of the second embroidery region.

2. The method according to claim 1, further comprising the steps of:

(f) storing at least one stitch pattern in a second memory;

(g) displaying on the display unit a display window showing at least one display box corresponding in number to the stitch pattern stored in the second memory;

(h) selecting a first display box out of the at least one display box displayed on the display unit; and (i) storing the stitch pattern relating to the first display box in the first memory, wherein the first memory stores only one stitch pattern.

3. The method according to claim 2, further comprising the step of (j) modifying the stitch pattern of the second embroidery region which is set in the step (e).

4. The method according to claim 2, wherein the display window showing the at least one display box is removed from the display unit by a user manipulating an operation unit, and the step (g) is executed by the user inputting a command through the operation unit.

5. The method according to claim 3, wherein the display window showing the at least one display box displayed on the display unit is moved by the user manipulating the operation unit.

6. The method according to claim 1, wherein the step (b) and step (c) are executed simultaneously by a first button of an operation unit being pressed while a mouse pointer displayed on the display unit is located within the first embroidery region, and the step (d) and the step (e) are executed simultaneously by a second button of the operation unit being pressed while the mouse pointer is located within the second embroidery region.

7. The method according to claim 1, wherein the stitch pattern includes at least one of a thread color, a stitch form, a stitch direction, a stitch density, and a stitch width.

8. An embroidery data generating device comprising:

a display unit that displays a plurality of embroidery regions making up an embroidery pattern;

an operation unit;

a first memory that stores a stitch pattern of a first embroidery region selected by the user manipulating the operation unit;

setting means for setting the stitch pattern stored in the first memory as a stitch pattern of a second embroidery region, the second embroidery region being selected by the user manipulating the operation unit.

9. The embroidery data generating device according to claim 8, further comprising a second memory that stores at least one stitch pattern, wherein a selective one of the at least one stitch pattern is stored in the first memory, and the first memory stores only one stitch pattern.

10. The embroidery data generating device according to claim 9, wherein the display unit displays a display window showing at least one palette corresponding in number to the stitch pattern stored in the second memory, the selective one of the at least one stitch pattern is selected by the user selecting a corresponding palette out of the at least one pallet shown in the display window by manipulating the operation unit.

11. The embroidery data generating device according to claim 10, further comprising an input unit through which the user inputs the stitch pattern of the first embroidery region and modifies the stitch pattern of the second embroidery region.

12. The embroidery data generating device according to claim 10, wherein the operation unit includes a mouse having a first button and a second button, and a mouse pointer displayed on the display unit, the stitch pattern of the first embroidery region is stored in the first memory by the user pressing the first button while the mouse pointer is located within the first embroidery region, and the stitch pattern stored in the first memory is set as the stitch pattern of the second embroidery region by the user pressing the second button while the mouse pointer is located within the second embroidery region.

13. The embroidery data generating device according to claim 8, wherein the stitch pattern includes at least one of a thread color, a stitch form, a stitch direction, a stitch density, and a stitch width.

14. A program storage medium storing a program for controlling an embroidery data generating device, the program comprising:

a program of displaying a plurality of embroidery regions making up an embroidery pattern on a display unit;

a program of selecting a first embroidery region out of the plurality of embroidery regions displayed on the display unit;

a program of storing a stitch pattern of the first embroidery region in a first memory;

a program of selecting a second embroidery region out of the plurality of embroidery regions; and a program of setting the stitch pattern stored in the first memory as a stitch pattern of the second embroidery region.

15. The program storage medium according to claim 14, wherein the program further comprises a program of storing at least one stitch pattern in a second memory, and a program of storing a selective one of the at least one stitch pattern in the first memory, wherein the first memory stores only one stitch pattern.

16. The program storage medium according to claim 15, wherein the program further comprises a program of displaying a display window showing at least one pallet corresponding in number to the stitch pattern stored in the second memory.

17. The program storage medium according to claim 16, wherein the program further comprises a program of modifying the stitch pattern of the second embroidery region.

18. The program medium according to claim 14 wherein the stitch pattern includes at least one of a thread color, a stitch form, a stitch direction, a stitch density, and a stitch width.

* * * * *